US008729993B2

(12) United States Patent
Ito et al.

(10) Patent No.: US 8,729,993 B2
(45) Date of Patent: May 20, 2014

(54) SOLENOID AND SHIFT DEVICE

(71) Applicant: Kabushiki Kaisha Tokai-Rika-Denki-Seisakusho, Aichi-ken (JP)

(72) Inventors: Hideaki Ito, Aichi-ken (JP); Yoshiyuki Miwa, Aichi-ken (JP)

(73) Assignee: Kabushiki Kaisha Tokai-Rika-Denki-Seisakusho, Aichi-Ken (JP)

( * ) Notice: Subject to any disclaimer, the term of this patent is extended or adjusted under 35 U.S.C. 154(b) by 0 days.

(21) Appl. No.: 13/705,872

(22) Filed: Dec. 5, 2012

(65) Prior Publication Data

US 2013/0147585 A1 Jun. 13, 2013

(30) Foreign Application Priority Data

Dec. 7, 2011 (JP) ..... 2011-268014

(51) Int. Cl.
*H01F 3/00* (2006.01)

(52) U.S. Cl.
USPC ..... 335/261; 335/266

(58) Field of Classification Search
USPC ..... 335/261
See application file for complete search history.

(56) References Cited

U.S. PATENT DOCUMENTS 2,102,761 A * 12/1937 Strobel ..... 315/302
4,097,833 A * 6/1978 Myers ..... 335/261
4,290,039 A * 9/1981 Tochizawa ..... 335/262
4,438,420 A * 3/1984 Leiber et al. ..... 335/275
4,473,141 A * 9/1984 Mochida ..... 477/94
4,887,702 A * 12/1989 Ratke et al. ..... 477/96
4,987,968 A * 1/1991 Martus et al. ..... 180/272
5,018,610 A * 5/1991 Rolinski et al. ..... 477/96
5,027,929 A * 7/1991 Ratke et al. ..... 477/94
5,076,114 A * 12/1991 Moody ..... 74/501.5 R
5,078,242 A * 1/1992 Ratke et al. ..... 477/96
5,096,033 A * 3/1992 Osborn ..... 477/96
5,129,494 A * 7/1992 Rolinski et al. ..... 477/96
5,176,231 A * 1/1993 Moody et al. ..... 192/220.2
5,211,271 A * 5/1993 Osborn et al. ..... 192/220.3
5,275,065 A * 1/1994 Ruiter ..... 74/483 R
5,522,277 A * 6/1996 Bollinger ..... 74/531
5,647,818 A * 7/1997 Moody ..... 477/99
5,677,658 A * 10/1997 Osborn et al. ..... 335/228
5,809,841 A * 9/1998 Smith ..... 74/531
5,842,364 A * 12/1998 Oliver ..... 70/202
5,862,899 A * 1/1999 Dahlstrom ..... 192/220.4

(Continued)

FOREIGN PATENT DOCUMENTS

JP 2011-168264 A 9/2011

*Primary Examiner* — Shawki S Ismail
*Assistant Examiner* — Lisa Homza
(74) *Attorney, Agent, or Firm* — Roberts Mlotkowski Safran & Cole P.C.

(57) ABSTRACT

In a solenoid, a coil is energized in a state where movement of a plunger toward the inside of a yoke is stopped. Accordingly, when the coil is energized, it suffice that movement of the plunger toward the outside of the yoke is inhibited by a magnetic force, and it is not necessary to move the plunger into the yoke by the magnetic force. Therefore, it is not necessary that a force moving the plunger toward the inside of the yoke is increased by a conventional core. Accordingly, the conventional core is not assembled in a frame, so that number of components can be decreased so as to reduce the cost.

3 Claims, 7 Drawing Sheets

(56) References Cited

U.S. PATENT DOCUMENTS

| | | | | |
|---|---|---|---|---|
| 5,902,209 | A * | 5/1999 | Moody | 477/99 |
| 6,059,687 | A * | 5/2000 | Durieux et al. | 477/94 |
| 6,308,813 | B1 * | 10/2001 | Carlson | 192/220.3 |
| 6,592,492 | B1 * | 7/2003 | Kalia | 477/96 |
| 6,676,564 | B2 * | 1/2004 | Gruden | 477/96 |
| 6,817,966 | B2 * | 11/2004 | Avers et al. | 477/96 |
| 6,879,480 | B2 * | 4/2005 | Kalia | 361/160 |
| 7,597,649 | B2 * | 10/2009 | Wang | 477/99 |
| 8,106,734 | B2 * | 1/2012 | Gruden | 335/229 |
| 8,400,242 | B2 * | 3/2013 | Zelmer et al. | 335/220 |

* cited by examiner

PRIOR ART

PRIOR ART

SOLENOID AND SHIFT DEVICE

CROSS-REFERENCE TO RELATED APPLICATION

This application claims priority under 35 USC 119 from Japanese Patent Application No. 2011-268014 filed Dec. 7, 2011, the disclosure of which is incorporated by reference herein.

BACKGROUND OF THE INVENTION

1. Field of the Invention

The present invention relates to a solenoid in which a moving force toward one side is acted on a plunger when a coil is energized and a shift device provided with the solenoid.

2. Related Art

For example, a shift lever device disclosed in Japanese Patent Application Laid-Open (JP-A) No. 2011-168264 includes a magnet that is of an electric magnet, and a plunger (movable iron core) is provided inside a coil and the plunger and the coil are accommodated in a frame (yoke) in a case that the plunger is provided in the magnet. When the magnet (coil) is energized to generate a magnetic force, a moving force into the frame (into the coil) acts on the plunger to inhibit movement of the plunger to an outside of the frame (to the outside of the coil), and the magnet (plunger) attracts a yoke plate.

An operation of a shift lever from a "P" shift position is permitted, when the magnet is energized to inhibit the movement of the plunger to the outside of the frame and the magnet attracts the yoke plate. On the other hand, the operation of the shift lever from the "P" shift position is inhibited, when the magnet is not energized to permit the movement of the plunger to the outside of the frame and the magnet does not attract the yoke plate.

At this point, in the magnet, a core (fixed iron core) is assembled in the frame and disposed in coaxial with the plunger. A force attracting to the core by the magnetic force acts on the plunger to increase the moving force into the frame acting on the plunger, when the magnet is energized.

However, in the shift lever device, due to the yoke plate being brought into surface contact with the magnet (plunger) by a biasing force, the plunger comes into contact with the core, and the movement of the plunger into the frame is stopped, the magnet is energized. When the magnet is energized, it suffices that the movement of the plunger into the frame is inhibited (the plunger is retained in the frame), it is not necessary to move (attract) the plunger into the frame. Accordingly, it is not necessary that the moving force into the frame acting on the plunger be increased by the core.

Here, if the structure is possible such that the core is not assembled in the frame in the magnet, the number of components can be decreased to reduce cost.

SUMMARY OF THE INVENTION

The present invention is to obtain a solenoid and a shift device, in which the cost can be reduced.

A solenoid of a first aspect of the invention includes: a coil that can be energized; a plunger that is provided in the coil, a moving force toward one side in an axial direction of the plunger acting on the plunger when the coil is energized; and a frame in which the plunger is accommodated, the coil being energized in a state in which the plunger comes into contact with the frame so as to stop movement of the plunger toward the one side.

A shift device of a second aspect of the invention includes: a shift member, a shift position being changed by operating the shift member; a solenoid including: a coil that can be energized; a plunger that is provided in the coil, a moving force toward one side in an axial direction of the plunger acting on the plunger when the coil is energized; and a frame in which the plunger is accommodated, the coil being energized in a state in which the plunger comes into contact with the frame so as to stop movement of the plunger toward the one side; and an inhibiting mechanism in which inhibiting and permission of operation of the shift member from a predetermined shift position are switched by switching between energization and non-energization of the coil so as to switch between inhibition and permission of movement of the plunger toward the other side in the axial direction.

In the solenoid of the first aspect of the present invention, the plunger is provided in the coil, and the moving force toward the one side acts on the plunger when the coil is energized. The plunger is accommodated in the frame.

At this point, the coil is energized in the state in which the plunger is brought into contact with the frame to stop the movement of the plunger toward the one side. Accordingly, when the coil is energized, it is not necessary to move the plunger toward the one side. Therefore, it is not necessary to increase the moving force toward the one side acting on the plunger.

Therefore, the plunger is brought into contact with the frame to stop the movement of the plunger toward the one side, and a core is not assembled in the frame. Accordingly, the number of components can be decreased to reduce the cost.

In the shift device of the second aspect of the present invention, the plunger is provided in the coil in the solenoid, and the moving force toward the one side acts on the plunger when the coil is energized. The plunger is accommodated in the frame.

In the inhibiting mechanism, the inhibiting and the permission of the operation of the shift member from the predetermined shift position are switched by switching the energization and the non-energization of the coil to switch the inhibiting and the permission of the movement of the plunger toward the other side.

At this point, the coil is energized in the state in which the plunger is brought into contact with the frame to stop the movement of the plunger toward the one side. Accordingly, when the coil is energized, it suffices that the movement of the plunger toward the other side is inhibited, and it is not necessary to move the plunger toward the one side. Therefore, it is not necessary to increase the moving force toward the one side acting on the plunger.

Therefore, the plunger is brought into contact with the frame to stop the movement of the plunger toward the one side, and the core is not assembled in the frame. Accordingly, the number of components can be decreased to reduce the cost.

In the first aspect or the second aspect, it is possible that the frame includes a bottom wall as a contact member at the one side thereof, the plunger includes a base end portion at the one side thereof, and the coil is energized in a state in which the base end portion of the plunger comes into contact with the bottom wall of the frame so as to stop movement of the plunger toward the one side.

Accordingly, it is possible that, in the frame, a fixed magnetic material member such as the core is not provided between the base end portion of the plunger as a movable magnetic material member and the bottom wall of the frame.

Further, it is possible that the movement of the plunger toward the one side is a movement of the plunger toward an inside of the frame.

Further, it is possible that the coil is energized in a state in which the base end portion of the plunger comes into surface-contact with the bottom wall of the frame.

BRIEF DESCRIPTION OF THE DRAWINGS

An embodiment of the invention will be described in detail with reference to the following figures, wherein.

DETAILED DESCRIPTION OF THE INVENTION

Figure 1:
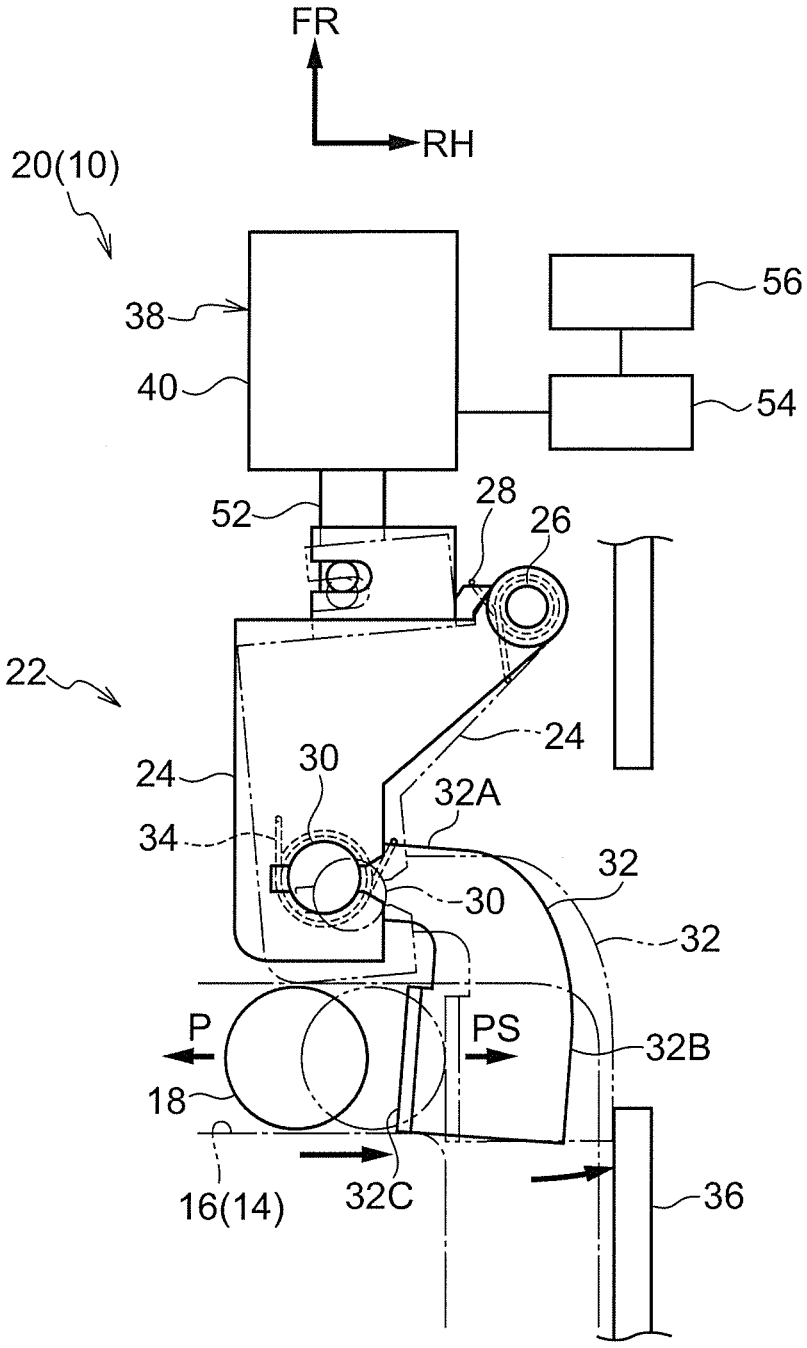
FIG. 1 is a plan view illustrating a shift lock state of a shift lock mechanism in a shift lever device according to an embodiment of the invention when the shift lock mechanism is viewed from above.
Figure 3:
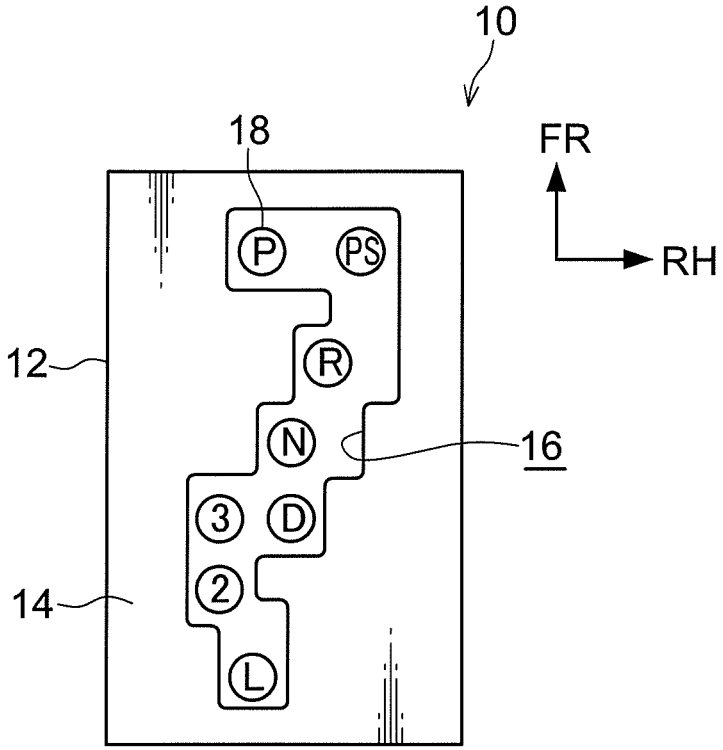
FIG. 3 is a plan view illustrating the shift lever device of the embodiment of the invention when the shift lever device is viewed from above.

FIG. 1 is a plan view illustrating a main part of a shift lever device 10 as a shift device according to an embodiment of the invention when the shift lever device 10 is viewed from above, and FIG. 3 is a plan view illustrating the shift lever device 10 when the shift lever device 10 is viewed from above. In the drawings, a vehicle front direction is indicated by an arrow FR, and a vehicle right direction is indicated by an arrow RH, and an upside is indicated by an arrow UP.

The shift lever device 10 according to the embodiment is what is called a floor type and a gate type shift lever device.

As illustrated in FIG. 3, a housing 12 having a substantially rectangular parallelopiped box shape is provided as an installation member in the shift lever device 10, and the housing 12 is installed in a vehicle front side portion and a central portion in a vehicle right and left direction (vehicle width direction) of a floor portion in a vehicle interior of a vehicle. An upper wall of the housing 12 is a plate-like cover 14, and an operating groove 16 having a predetermined folded shape is formed as an operating passage in the cover 14 while the cover 14 is pierced.

A shift lever 18 having a substantially cylindrical rod shape is provided as a shift member in the shift lever device 10. A lower end of the shift lever 18 is supported at a lower end of the housing 12, and the shift lever 18 is operable (rotatable) about the lower end in the front and rear directions and the right and left directions of the vehicle.

An upper side portion of the shift lever 18 is inserted in the operating groove 16 of the cover 14, and a shift position is changeable to a "P" shift position as a predetermined shift position, an "R" shift position, an "N" shift position, a "D" shift position, a "3" shift position, a "2" shift position, and an "L" shift position by operating the shift lever 18 along the operating groove 16. In a case that the shift lever 18 is operated from the "P" shift position to the "R" shift position, the shift lever 18 is operated in this order rearward and leftward (the other side in the vehicle width direction) after operated rightward (one side in the vehicle width direction) to reach a "PS" position.

A shift lock mechanism 20 (shift lock unit) shown in FIG. 1 is fixed in the housing 12, and the shift lock mechanism 20 is disposed on the lower side and the vehicle front side of the "PS" position of the operating groove 16 of the cover 14.

An inhibiting (inhibiting) mechanism 22 is provided in the shift lock mechanism 20.

In the inhibiting mechanism 22, a first link 24 having a substantially rectangular parallelopiped shape is provided as an installation member in the vehicle front side portion. The first link 24 is supported, at an end portion which is on the vehicle front side and a vehicle right side thereof, at a circular shape turn shaft 26 so as to be turnable about the turn shaft 26. The first link 24 is turnable in the right and left directions of the vehicle between a permission position (a release position indicated by a solid line in FIG. 1) that is of an initial position and a inhibiting position (a lock position indicated by a two-dot chain line in FIG. 1).

A first return spring 28 as a first biasing member that constitutes a biasing member is provided in the turn shaft 26 of the first link 24. The first return spring 28 is a torsion coil spring and biases the first link 24 toward the vehicle left side.

A circular support shaft 30 is fixed to the rear side portion of the vehicle of the first link 24, and projected downward from the first link 24.

A U-shape rod-like second link 32 as a moving member is provided at the vehicle rear side of the first link 24. The second link 32 is turnably supported by the support shaft 30 of the first link 24 at a base end 32A (the end portion on the vehicle front side).

A second return spring 34 as a second biasing member that constitutes the biasing member is provided in the support shaft 30 of the first link 24. The second return spring 34 is a torsion coil spring that is bridged between the first link 24 and the second link 32. The second return spring 34 biases the second link 32 toward the vehicle left side, and the turning of the second link 32 is stopped at (restricted by) the first link 24. Therefore, the second link 32 is disposed at the initial position, and a leading end 32B (the end portion on the vehicle rear side) of the second link 32 is disposed below the "PS" position of the operating groove 16 of the cover 14. A biasing force of the second return spring 34 is larger than a biasing force of the first return spring 28.

A vehicle left side surface of the leading end 32B of the second link 32 is a planar lock surface 32C that is as an inhibiting portion, and the lock surface 32C is disposed perpendicular to the right and left direction of the vehicle. When the shift lever 18 is operated from the "P" shift position to reach the "PS" position, the lock surface 32C of the second link 32 is pressed toward the vehicle right side by the shift lever 18. The lock surface 32C may be tilted in the rightward direction or the leftward direction of the vehicle on progression the vehicle frontward.

A catch plate 36 as a catch member, having a flat plate shape, is fixed at the vehicle right side with respect to the vehicle rear side end of the second link 32, and a vehicle left side surface of the catch plate 36 is disposed perpendicular to the right and left direction of the vehicle. The catch plate 36 is not disposed at the vehicle right side with respect to a portion of the second link 32 which portion is other than the vehicle rear side end of the second link 32. The catch plate 36 may be constructed by a part (including a peripheral edge of a gate groove) of a plate-like high strength gate, in which strength is higher than that of the cover 14 and a gate groove is formed to pierce the gate. The gate groove is formed into the substantially same shape as the operating groove 16, and the shift lever 18 pierces the gate groove.

A solenoid 38 (electric magnet) that is as an attraction unit and a switching unit is fixed at the vehicle front side of the inhibiting mechanism 22 (the first link 24). The solenoid 38 stops turning caused by the biasing force of the first return spring 28 of the first link 24 to stop the first link 24 at the permission position.

Figure 4:
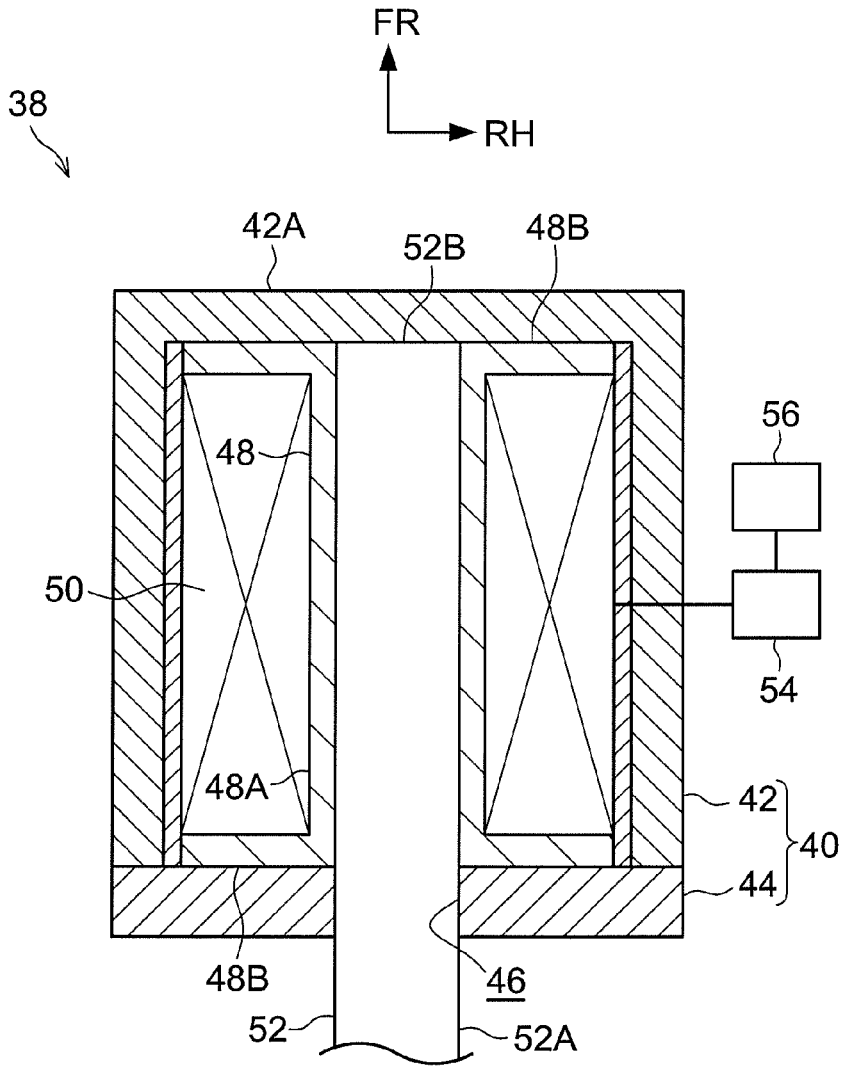
FIG. 4 is a sectional view illustrating a solenoid of the shift lock mechanism in the shift lever device of the embodiment of the invention when the solenoid is viewed from above.

As illustrated in FIG. 4, a yoke 40 having a rectangular parallelopiped box shape is provided as an accommodation member in the solenoid 38. The yoke 40 is made of metal (for example, iron) that is a magnetic material (magnetic substance). A frame 42 having a rectangular tube shape with a bottom is provided as a first yoke in the yoke 40. In the frame 42, a wall on the vehicle front side constitutes a bottom wall 42A (contact portion) having a flat plate shape, and a vehicle rear side is opened. A plate 44 having a rectangle plate shape is provided as a second yoke in the yoke 40. The plate 44 closes the vehicle rear side of the frame 42. A circular through-hole 46 is formed in pierced manner in the plate 44, and disposed in coaxial with the yoke 40.

A resin coil frame 48 is accommodated inside the yoke 40. A cylindrical wind barrel (tube) 48A is provided in the coil frame 48, and bridged between the bottom wall 42A of the frame 42 and the plate 44. The wind barrel 48A is disposed in coaxial with the yoke 40, and the whole inside the winding barrel 48A faces the whole of the through-hole 46 of the plate 44. Flanges 48B having an rectangular plate-like outer shape are integrally provided in outer peripheries at a vehicle front side end and a vehicle rear side end of the wind barrel 48A, and the pair of flanges 48B are fitted inside the yoke 40 (the frame 42) while being in contact with the bottom wall 42A and the plate 44 of the frame 42 respectively.

A metallic (for example, copper) coil 50 that is a conductor is wound around the wind barrel 48A of the coil frame 48, thereby mounting the coil 50 on the coil frame 48.

A metallic (for example, iron) circular cylinder plunger 52 (movable iron core (movable magnetic material member)) that is magnetic material is fitted inside the wind barrel 48A of the coil frame 48 and inside the through-hole 46 of the plate 44. The plunger 52 is movable (slidable) inside the wind barrel 48A and the through-hole 46. A leading end 52A (vehicle rear side end portion) of the plunger 52 is projected from the plate 44 toward the vehicle rear side and is coupled to the first link 24, and the first link 24 is turnable by moving of the plunger 52. The biasing force of the first return spring 28 acts on the plunger 52 through the first link 24, and (a vehicle front side end face of) the base end 52B (vehicle front side end portion) of the plunger 52 is brought into surface contact with (a vehicle rear side face of) the bottom wall 42A of the frame 42.

The coil 50 of the solenoid 38 is electrically connected to a control device 54 of the vehicle. A brake 56 of the vehicle is electrically connected to the control device 54, and the vehicle is braked by operating the brake 56.

In a state in which the brake 56 is operated, under the control of the control device 54, the coil 50 of the solenoid 38 is energized to generate a magnetic force. Therefore, a moving force toward inside of the yoke 40 (toward inside of the coil 50, toward the vehicle front side (one side in the axial direction)) acts on the plunger 52 by the magnetic force, so the movement of the plunger 52 toward the outside of the yoke 40 (toward the outside of the coil 50, toward the vehicle rear side) is inhibited (blocked) (the plunger 52 is retained inside the yoke 40). The solenoid 38 inhibits the turning of the first link 24 toward the vehicle right side (inhibiting direction), whereby the first link 24 is retained at the permission position, and put into a permission state (lock release state).

The biasing force of the second return spring 34 is smaller than the total of the inhibiting force inhibiting the movement of the plunger 52 toward the outside of the yoke 40 by the solenoid 38 (a force retaining the plunger 52 in the yoke 40) and the biasing force of the first return spring 28. Therefore, in a state in which the first link 24 is retained at the permission position by the solenoid 38 as described above, the second link 32 is turnable against the biasing force of the second return spring 34, and the lock surface 32C of the second link 32 is turnable toward the vehicle right side and the vehicle front side (permission direction).

On the other hand, in a state in which the brake 56 is not operated, under the control of the control device 54, the coil 50 of the solenoid 38 is not energized and the coil 50 does not generate the magnetic force. Therefore, the moving force toward inside the yoke 40 does not act on the plunger 52 by the magnetic force, so the plunger 52 is permitted to move toward the outside of the yoke 40. Therefore, the first link 24 is permitted to turn toward the vehicle right side, whereby the first link 24 is turnable from the permission position toward the inhibiting position, and put into the inhibiting state (lock state).

An operation of the embodiment will be described below.

In the shift lever device 10 having the above configuration, when the shift lever 18 is operated from the "P" shift position to reach the "PS" position, the lock surface 32C of the second link 32 is pressed toward the vehicle right side by the shift lever 18.

In a state in which the brake 56 is not operated, under the control of the control device 54, the coil 50 of the solenoid 38 is not energized, and the plunger 52 of the solenoid 38 is permitted to move toward the outside of the yoke 40. The biasing force of the second return spring 34 is larger than the biasing force of the first return spring 28.

Accordingly, when the shift lever 18 presses (pushes) the lock surface 32C of the second link 32 toward the vehicle right side, as indicated by the two-dot chain line in FIG. 1, the first link 24 and the second link 32 turn toward the vehicle right side against the biasing force of the first return spring 28 in a state in which the turning of the second link 32 with respect to the first link 24 against the biasing force of the second return spring 34 is inhibited, so the first link 24 is disposed at the inhibiting position, and the second link 32 is caught at the catch plate 36. Accordingly, the turning of the second link 32 by the pressing force of the shift lever 18 is stopped by the catch plate 36, and the lock surface 32C of the second link 32 does not turn toward the vehicle right side and the vehicle front side. Therefore, the operation of the shift lever 18 to the "PS" position is blocked by the lock surface 32C of the second link 32, so as to block (lock) the operation of the shift lever 18 from the "P" shift position to the "R" shift position.

On the other hand, in a state in which the brake 56 is operated, under the control of the control device 54, the coil 50 of the solenoid 38 is energized to block the movement of the plunger 52 of the solenoid 38 toward the outside of the yoke 40. The biasing force of the second return spring 34 is smaller than the total of the biasing force of the first return spring 28 and the inhibiting force inhibiting the movement of the plunger 52 toward the outside of the yoke 40 by the solenoid 38.

Figure 2:
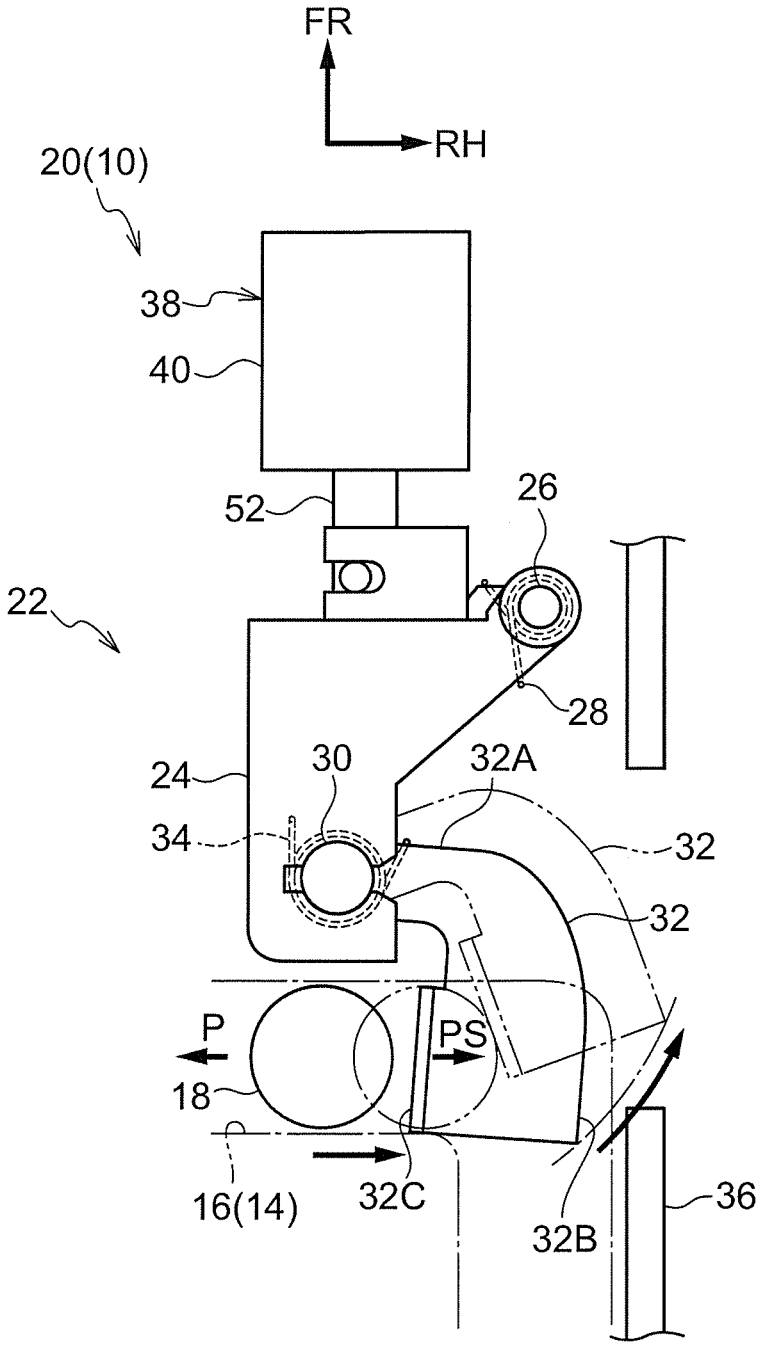
FIG. 2 is a plan view illustrating a shift unlock state of the shift lock mechanism in the shift lever device of the embodiment of the invention when the shift lock mechanism is viewed from above.

When the shift lever 18 presses (pushes) the lock surface 32C of the second link 32 toward the vehicle right side, as indicated by the two-dot chain line in FIG. 2, the second link 32 turns against the biasing force of the second return spring 34 in a state in which the turning of the first link 24 and the second link 32 toward the vehicle right side against the biasing force of the first return spring 28 and the inhibiting force inhibiting the movement of the plunger 52 toward the outside of the yoke 40 by the solenoid 38 is blocked (in a state in which the first link 24 is disposed at the permission position), and the second link 32 is not caught at the catch plate 36. Therefore, the lock surface 32C of the second link 32 turns toward the vehicle right side and the vehicle front side to permit the operation of the shift lever 18 to the "PS" position, so the operation of the shift lever 18 from the "P" shift position to the "R" shift position is permitted (lock released).

At this point, in the solenoid 38, due to the biasing force of the first return spring 28 acting on the plunger 52 through the first link 24, the base end 52B of the plunger 52 is brought into surface contact with the bottom wall 42A of the frame 42, and the coil 50 is energized in a state in which the movement of the plunger 52 toward the inside of the yoke 40 (toward the vehicle front side) is stopped. Accordingly, when the coil 50 is energized, it suffices that the movement of the plunger 52 toward the outside of the yoke 40 (toward the vehicle rear side) is blocked by the magnetic force (it suffices that the plunger 52 is retained in the yoke 40 by the magnetic force), but it is not necessary to move (attract) the plunger 52 into the yoke 40 by the magnetic force. Therefore, it is not necessary that the force acting on the plunger 52 moving toward the inside of the yoke 40 be increased by a conventional core 72 (fixed iron core (fixed magnetic material member), see FIG. 6).

The base end 52B of the plunger 52 is brought into surface contact with the bottom wall 42A of the frame 42, and the movement of the plunger 52 toward the inside of the yoke 40 is stopped, and the conventional core 72 is not assembled in the bottom wall 42A of the frame 42. Accordingly, in the solenoid 38, the number of components can be reduced, and especially the necessity of assembling the core 72 by caulking in the bottom wall 42A of the frame 42 is eliminated, so that the number of assembling processes can be reduced to reduce the cost.

Because the conventional core 72 is not provided in the solenoid 38, variation factors in quality (for example, the force retaining the plunger 52 in the yoke 40 by the energization of the coil 50, and the force retaining the plunger 52 in yoke 40, which is remained, after ending of the energization of the coil 50) of the solenoid 38 can be reduced. Therefore, quality of the solenoid 38 can be stabilized.

In the solenoid 38, the conventional core 72 is not disposed in the wind barrel 48A of the coil frame 48, so that length of the plunger 52 can be lengthened in an axial direction.

Therefore, a weight of the plunger 52 can be increased, a position of center of gravity of the first link 24 and the second link 32 can be moved to the side of the plunger 52 by the plunger 52 and brought close to the turning shaft 26 when the first link 24 and the second link 32 turn integrally about the turning shaft 26 with the coil 50 being not energized. Accordingly, the integral turning of the first link 24 and the second link 32 can smoothly be performed, the turning of the second link 32 can properly be stopped by the catch plate 36, and the operation of the shift lever 18 to the "PS" position can properly be blocked.

Additionally, a length in the axial direction of the plunger 52 which length the plunger 52 is guided (inserted) inside the wind barrel 48A of the coil frame 48 can be lengthened, and a tilt amount (variation in position) of the plunger 52 with respect to the wind barrel 48A can be reduced.

In the embodiment, the base end 52B of the plunger 52 is formed into the cylindrical shape. Alternatively, for example, the base end 52B of the plunger 52 may be formed into a truncated cone shape, and a diameter of the base end 52B of the plunger 52 may be decreased on progression toward the base end side of the plunger 52.

In the embodiment, the first link 24 and the second link 32 are turnable. Alternatively, at least one of the first link 24 and the second link 32 may be slidable.

In the embodiment, the shift lock mechanism 20 is applied to the gate type shift lever device 10 in which the shift lever 18 can be operated in plural intersecting directions. Alternatively, the shift lock mechanism 20 may be applied to the straight type shift lever device in which the shift lever 18 can be operated only in one direction.

Particularly, in this case, in a configuration in which an operating button provided at an upper end (a leading end) of the shift lever 18 is operated and a grooved pin (a moving member) is moved to enable the operation of the shift lever 18 from the "P" shift position (predetermined shift position), the shift lock mechanism 20 switches between the inhibiting and the permission of movement of the grooved pin, whereby the shift lock mechanism 20 may switch the inhibiting and permission of the operation from the "P" shift position.

In the embodiment, the floor type shift lever device 10 is used and installed in the floor of the vehicle interior. Alternatively, the shift lever device 10 may be installed in a steering column of the vehicle, or the shift lever device 10 may be installed in an instrument panel of the vehicle.

First Experiment Example

Figure 5:
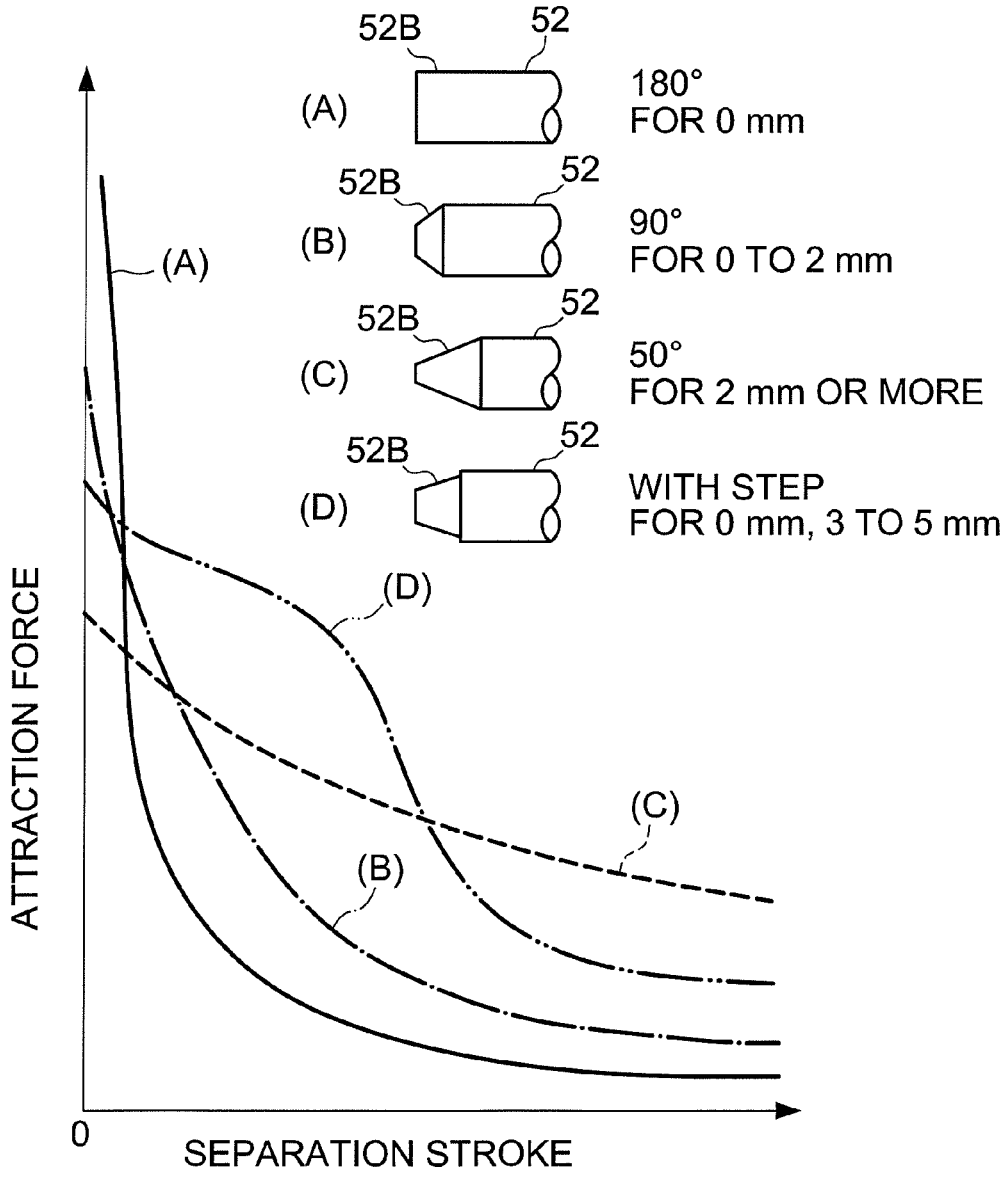
FIG. 5 is a graph illustrating a relationship between a separation stroke and a force moving a plunger in the solenoid of the invention.

FIG. 5 is a graph illustrating a relationship between a separation stroke and an attraction force (moving force). A horizontal axis indicates the separation stroke of the plunger 52 from the bottom wall 42A of the frame 42 in the axial direction, and a vertical axis indicates the force attracting the plunger 52 toward the inside of the yoke 40. In FIG. 5, (A) indicates a case that the base end 52B of the plunger 52 is formed into the cylindrical shape, and (B) to (D) indicate cases that the base end 52B of the plunger 52 is formed into the truncated cone shapes. In the case of (B), a tilt angle of a generating line with respect to an axis line in the base end 52B of the plunger 52 is set to 45°. In the case of (C), the tilt angle of the generating line with respect to the axis line in the base end 52B of the plunger 52 is set to 25°. In the case of (D), the maximum diameter of the base end 52B of the plunger 52 is smaller than a diameter of a portion of the plunger 52 near the base end 52B.

As illustrated in FIG. 5, in any cases (A) to (D) of the base end 52B of the plunger 52, the force attracting the plunger 52 toward the inside the yoke 40 can be increased by decreasing the separation stroke of the plunger 52 from the bottom wall 42A of the frame 42 in the axial direction. In a case of the extremely small separation stroke of the plunger 52 from the bottom wall 42A of the frame 42 in the axial direction (substantial zero), the force attracting the plunger 52 into the yoke 40 can be from small to large in the order of the cases (C), (D), (B), and (A) of the base end 52B of the plunger 52.

Second Experiment Example

Figure 6:
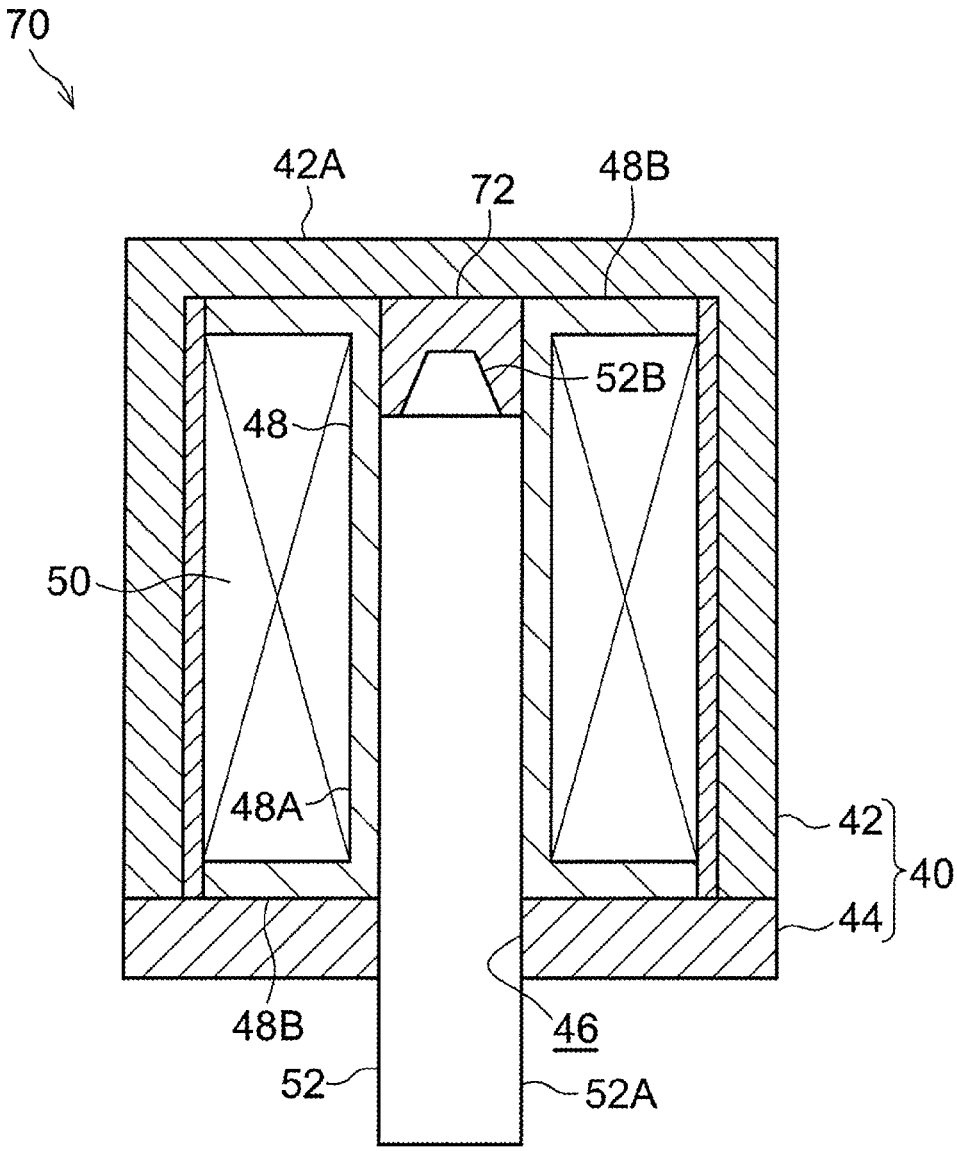
FIG. 6 is a sectional view illustrating a conventional solenoid.
Figure 7:
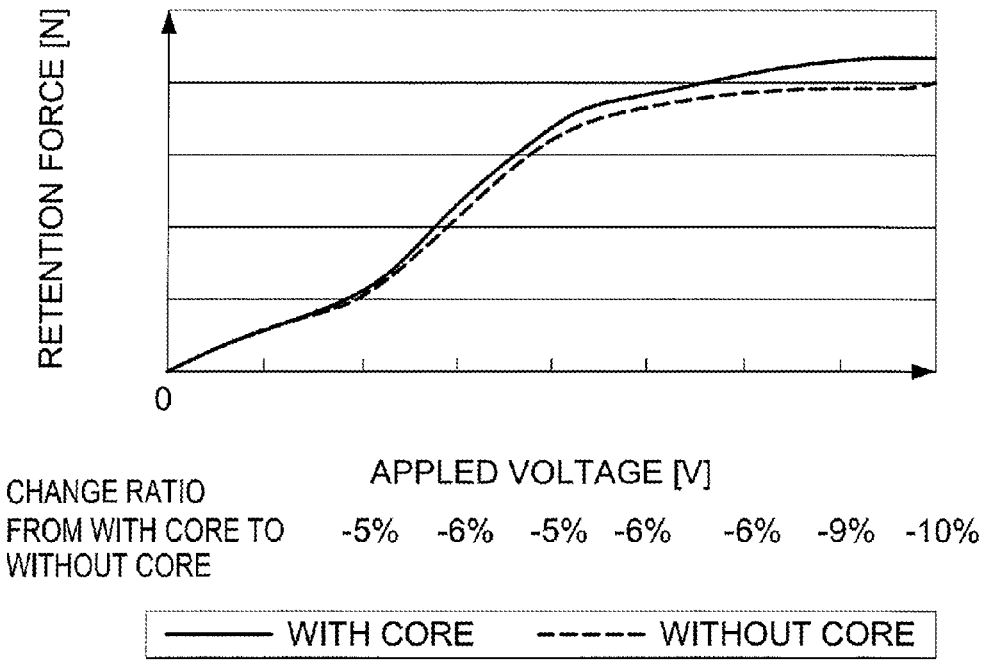
FIG. 7 is a graph illustrating a relationship between a voltage applied to a coil and a force retaining the plunger in a yoke in the conventional solenoid and the solenoid of the invention.

FIG. 6 is a cross-sectional view illustrating the conventional solenoid 70. FIG. 7 is a graph illustrating a relationship between a voltage applied to the coil 50 and the force retaining the plunger 52 toward the inside of the yoke 40 in the conventional solenoid 70 (with the core 72) and the solenoid 38 (without the core 72) of the present invention. The horizontal axis indicates the voltage applied to the coil 50, and the vertical axis indicates the force retaining the plunger 52 in the yoke 40 (the moving force necessary to act on the plunger 52 in order to move the plunger 52 toward the outside of the yoke 40 from the state in which the movement of the plunger 52 toward the inside of the yoke 40 is stopped by the core 72 or the bottom wall 42A of the frame 42).

As illustrated in FIG. 6, in the conventional solenoid 70, the core 72 having the cylindrical shape with a bottom is coaxially assembled in the bottom wall 42A of the frame 42, the core 72 is fitted in the wind barrel 48A of the coil frame 48. The inside of the core 72 is formed into the truncated cone shape in coaxial with the core 72, the diameter of the truncated cone decreases on progression toward the side of the bottom wall 42A, and the opposite side of the truncated cone to the bottom wall 42A is opened. The base end 52B of the plunger 52 is formed into the truncated cone shape, the diameter decreases on progression toward the base end side of the plunger 52, the maximum diameter is smaller than the diameter at a portion of the of the plunger 52 near the base end 52B, and the base end 52B of the plunger 52 can be inserted in the core 72.

In the second experimental example, the plunger 52 of the solenoid 38 of the present invention is the same as the plunger 52 of the conventional solenoid 70.

As illustrated in FIG. 7, in the solenoid 38 of the present invention, irrespective of the voltage applied to the coil 50, the force retaining the plunger 52 in the yoke 40 is merely slightly decreased with respect to that of the conventional solenoid 70. Additionally, in the solenoid 38 of the invention, even if the voltage applied to the coil 50 becomes larger, the decrement of the force retaining the plunger 52 in the yoke 40 with respect to the retention force of the conventional solenoid 70 is merely slightly increased.

Therefore, in the solenoid 38 of the present invention, irrespective of the voltage applied to the coil 50, the force retaining the plunger 52 in the yoke 40 can be large so as to expand the range (type) of the device to which the solenoid 38 of the invention can be applied.

What is claimed is:

1. A shift device comprising:

a shift member, a shift position being changed by operating the shift member;

a solenoid including:

a coil that can be energized;

a plunger that is provided in the coil, a moving force toward one side in an axial direction of the plunger acting on the plunger when the coil is energized; and a frame in which the plunger is accommodated, the coil being energized in a state in which the plunger comes into contact with the frame so as to stop movement of the plunger toward the one side, wherein the frame includes a one-piece, planar bottom wall as a contact member at the one side thereof, the plunger includes a base end portion at the one side thereof, and the coil is energized in a state in which the base end portion of the plunger comes into direct contact with the bottom wall of the frame so as to stop movement of the plunger toward the one side; and an inhibiting mechanism in which inhibiting and permission of operation of the shift member from a predetermined shift position are switched by switching between energization and non-energization of the coil so as to switch between inhibition and permission of movement of the plunger toward the other side in the axial direction.

2. The shift device of claim 1, wherein the coil is energized in a state in which the base end portion of the plunger comes into surface-contact with the bottom wall of the frame.

3. The shift device of claim 1, wherein the movement of the plunger toward the one side is a movement of the plunger toward an inside of the frame.

* * * * *